US009881709B2

(12) United States Patent
Beach et al.

(10) Patent No.: US 9,881,709 B2
(45) Date of Patent: Jan. 30, 2018

(54) GENERATING ELECTRICITY ON DEMAND FROM A NEUTRON-ACTIVATED FUEL SAMPLE

(71) Applicant: AAI Corporation, Hunt Valley, MD (US)

(72) Inventors: Rodney B. Beach, Littleton, CO (US); Robert J. Neugebauer, Shrewsbury, PA (US)

(73) Assignee: AAI Corporation, Hunt Valley, MD (US)

( * ) Notice: Subject to any disclaimer, the term of this patent is extended or adjusted under 35 U.S.C. 154(b) by 1124 days.

(21) Appl. No.: 14/138,561

(22) Filed: Dec. 23, 2013

(65) Prior Publication Data

US 2015/0357067 A1 Dec. 10, 2015

(51) Int. Cl.
*G21H 1/10* (2006.01)

(52) U.S. Cl.
CPC ..... *G21H 1/103* (2013.01)

(58) Field of Classification Search
USPC ..... 376/187, 321
See application file for complete search history.

(56) References Cited

U.S. PATENT DOCUMENTS 3,491,003 A * 1/1970 Baltisberger ..... C01G 99/006 205/261
H259 H * 4/1987 Tam ..... G21B 1/13 376/146
5,246,505 A * 9/1993 Mowery, Jr. ..... G21D 7/04 136/201
6,365,822 B1 4/2002 Dobry, Jr. et al.
7,273,981 B2 * 9/2007 Bell ..... B60H 1/2215 136/201
8,090,072 B2 1/2012 Rubbia
2008/0080659 A1 4/2008 Leung et al.

OTHER PUBLICATIONS

"Safe radioisotope thermoelectric generators and heat sources for space applications," R.C. O'Brien, R.M. Ambrosi, N.P. Bannister, S.D. Howe, H.V. Atkinson.*
Pankratov, et al., "Estimation of 210 Po Losses from the Solid 209 Bi Target Irradiated in a Thermal Neutron Flux," submitted for publication at Annals of Nuclear Energy (Sep. 2002), pp. 6, http://www.sciencedirect.com/science/article/pii/S0306454902001433.
"Processes and Characteristics of Major Isotopes Handled at Mound," Federation of American Scientists, pp. 62, http://fas.org/nuke/space/mound.pdf.

* cited by examiner

*Primary Examiner* — Sean P Burke
(74) *Attorney, Agent, or Firm* — BainwoodHuang

(57) ABSTRACT

A technique that uses a thermoelectric generator for generating electrical power employs a safe, initially dormant, stable, non-radioactive fuel sample which is activated on-demand by a neutron source to initiate and control activation of the fuel sample. The technique allows thermoelectric generators to be fully assembled and stored for extended periods of time before they are deployed for use, and then activated on demand only when the need arises for them to generate power.

15 Claims, 8 Drawing Sheets

GENERATING ELECTRICITY ON DEMAND FROM A NEUTRON-ACTIVATED FUEL SAMPLE

BACKGROUND

Thermoelectric generators are devices that produce heat (e.g., via combustion or radioactive decay) and convert the heat directly into electrical energy. Thermoelectric generators are more simple and reliable than conventional generators that use rotating components because they typically have fewer moving parts and require less maintenance.

Due to their exceptional reliability, thermoelectric generators are particularly well suited for remote installations and applications where maintenance is prohibitive. For example, thermoelectric generators fueled by radioisotopes are commonly employed as power sources for satellites and spacecraft where the vehicles are inaccessible after launch.

SUMMARY

Unfortunately, there are deficiencies in conventional thermoelectric generators. Many thermoelectric generators use radioisotope fuels as a source of heat. However, the radioisotope fuels in such generators immediately start to decay once the generators are assembled. Thus, conventional thermoelectric generators constructed with radioisotope fuels generally cannot be stored for extended periods of time before they are used. In addition, conventional thermoelectric generators fueled by radioisotopes require high purity radioisotopes such as plutonium. Production of high purity plutonium is prohibitively expensive. Additionally, handling and storage of plutonium requires extreme caution and costly safeguards. Further, spent plutonium waste is radioactive and, as a result, handling, disposal and storage of spent material is problematic and costly due to the prolonged half-life of plutonium isotopes.

In contrast with conventional approaches, improved techniques are directed to thermoelectric generators which employ a safe, initially dormant, stable, non-radioactive fuel sample which is activated on-demand by a neutron source which initiates and controls activation of the fuel sample. The improved techniques thus allow thermoelectric generators to be fully assembled and stored for extended periods of time before they are deployed for use, and then activated on demand only when the need arises for them to generate power.

In some examples, the fuel source includes radioactively stable Bismuth 209 ($Bi^{209}$), which converts to $Bi^{210}$ when it is exposed to neutron radiation. The $Bi^{210}$ then radioactively decays into Polonium 210 ($Po^{210}$), which in turn radioactively decays into stable lead ($Pb^{206}$). Thus, not only is the fuel sample initially stable, but also it is stable after the fuel is spent. Moreover, radioactive decay of $Po^{210}$ merely releases alpha particles, which are generally harmless to humans unless ingested or inhaled.

Some embodiments are directed to a thermoelectric generator with on-demand activation. The thermoelectric generator includes a fuel sample and a neutron source constructed and arranged to emit neutrons into the fuel sample to initiate radioactive decay reactions in the fuel sample in response to the neutron source receiving an activation input. The thermoelectric generator also includes a thermoelectric converter coupled to the fuel sample to convert thermal energy from the radioactive decay reactions to electrical energy Other embodiments are directed to a method for generating electrical power on demand. The method includes receiving an activation input and, in response to receiving the activation input, activating a neutron source to irradiate a fuel sample with neutrons to initiate radioactive decay reactions in the fuel sample to generate heat. The method further includes converting the heat from the radioactive decay reactions to electrical energy.

Further embodiments are directed to a thermoelectric generator with on-demand activation which includes multiple fuel samples each including Bi209. The thermoelectric generator further includes multiple neutron sources, each neutron source disposed in relation to one of the fuel samples to emit neutrons into the respective fuel sample to initiate radioactive decay reactions in the fuel sample in response to the neutron source receiving an activation input. The thermoelectric generator further includes multiple thermoelectric converters, each thermoelectric converter coupled a respective one of the fuel samples to convert thermal energy from the radioactive decay reactions in the fuel sample to electrical energy. The thermoelectric generator further includes control circuitry coupled to each of the neutron sources to provide the respective activation input to each of the neutron sources, wherein the control circuitry is constructed and arranged to apply activation inputs to the neutron sources in a timing sequence to expose the respective fuel samples to neutron emission at different times, such that, as radioactive decay reactions in one fuel sample diminish over time, radioactive decay reactions in another fuel sample are increased to extend a service life of the thermoelectric generator.

BRIEF DESCRIPTION OF THE DRAWINGS

The foregoing and other features and advantages will be apparent from the following description of particular embodiments of the invention, as illustrated in the accompanying drawings, in which like reference characters refer to the same parts throughout the different views. The drawings are not necessarily to scale, emphasis instead being placed upon illustrating the principles of various embodiments of the invention. In the accompanying drawings.

DETAILED DESCRIPTION OF THE INVENTION

Embodiments of the invention will now be described. It is understood that such embodiments are provided by way of example to illustrate various features and principles of the invention, and that the invention hereof is broader than the specific example embodiments disclosed.

Improved techniques are directed to thermoelectric generators which employ a safe, initially dormant, stable, non-radioactive fuel sample which is activated on-demand by a neutron source which initiates and controls activation of the fuel sample. An activation input activates the neutron source to emit neutrons into the fuel sample and cause radioactive decay reactions that generate heat. A thermoelectric converter coupled to the fuel sample converts thermal energy produced by the radioactive decay reactions to electrical energy.

In an example, a stable non-radioactive fuel sample includes $Bi^{209}$. Upon exposure to neutron irradiation, the $Bi^{209}$ undergoes conversion to $Po^{210}$ which undergoes radioactive decay to stable $Pb^{206}$ and generates heat. Heat energy is generated primarily from radioactive decay of $Po^{210}$.

Figure 1:
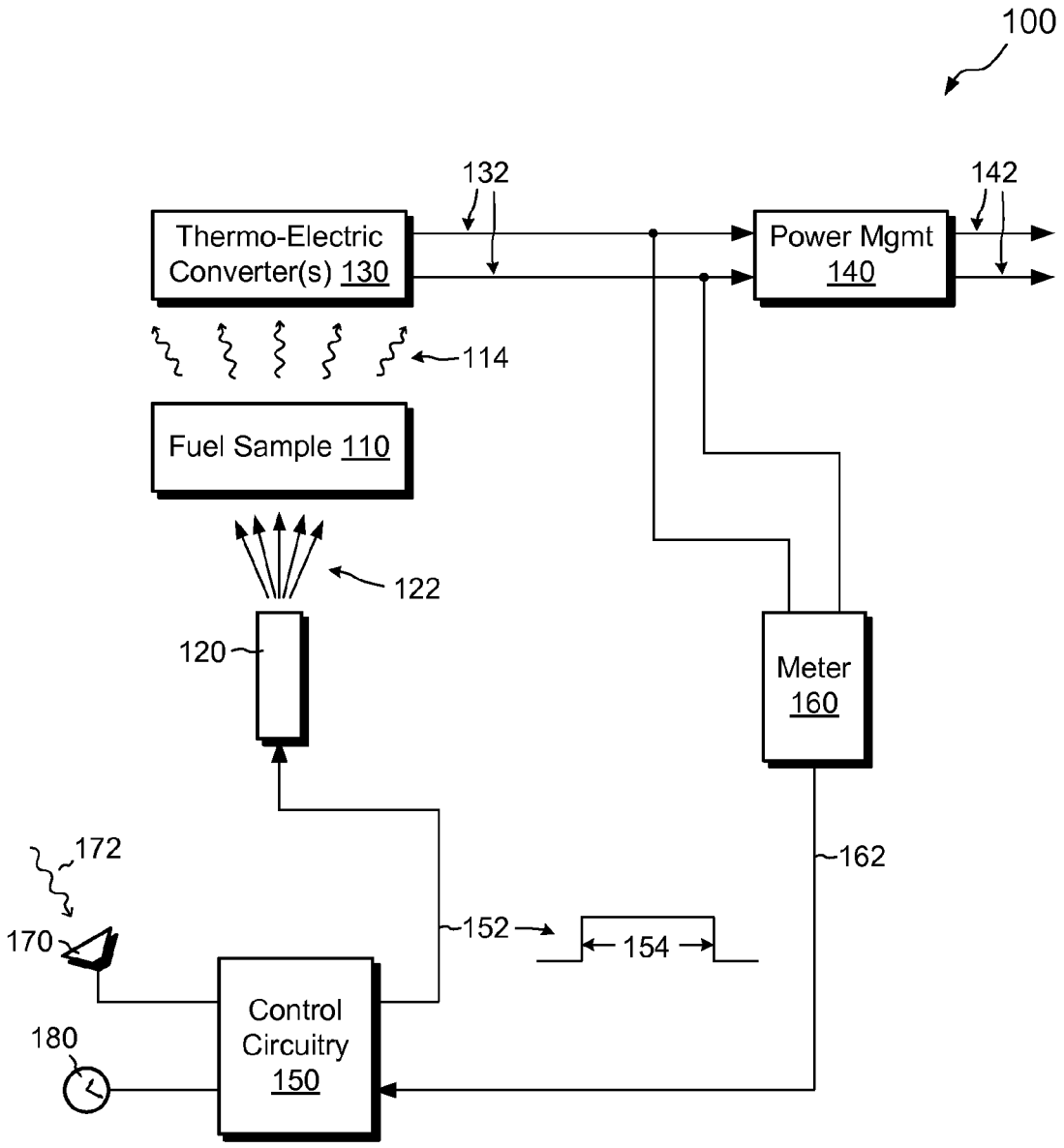
FIG. 1 is block diagram of one example of a thermoelectric generator illustrating activation of a fuel sample by irradiating the fuel sample with a neutron source.

FIG. 1 shows a block diagram of a thermoelectric generator 100, which includes a neutron source 120 that receives an activation input 152. The neutron source 120 is positioned in relation to a fuel sample 110 such that the fuel sample 110 is exposed to neutrons 122, which are emitted from the neutron source 120. A set of thermoelectric converters 130 (i.e., one or more thermoelectric converters) are positioned in relation to the fuel sample 110 to convert heat 114 to electricity 132.

In some examples, control circuitry 150 provides the activation input 152. The control circuitry 150 may be coupled to a communication receiver 170 to receive communication signals, such as a remote activation signal, and to a timing circuit 180 (e.g., a clock) to provide the control circuitry 150 with a timing reference.

In some examples, the thermoelectric converters 130 are coupled to a power management module 140 that produces regulated electrical output 142. Also, a meter 160 (e.g., a voltmeter, ammeter, wattmeter, etc.) may be coupled to the electrical output 132 (or 142) to provide a feedback signal 162 to the control circuitry 150. Other meters or indicators (not shown) may also be provided, such as an indicator to displaying the remaining amount of energy remaining in the generator 100.

In operation, the neutron source 120 receives the activation signal 152. In response to receiving the activation signal 152, the neutron source 120 generates neutrons 122, which impinge upon the fuel sample 110. The neutrons 122 convert atoms of $Bi^{209}$ in the fuel sample to $Bi^{210}$. A radioactive decay process ensues whereby atoms of $Bi^{210}$ decay to $Po^{210}$, which in turn decay into $Pb^{206}$, releasing alpha particles and heat 114. The set of thermoelectric converters 130 convert energy of the heat 114 to energy of electricity 132. Power management 140 may optionally regulate the electricity 132 (e.g., to produce stable output voltage). In some examples, multiple thermoelectric converters 130 are used, and the power management 140 may further combine outputs to form series and/or parallel output combinations. Further, multiple generators like the generator 100 may be used in combination, with the power management 140 operating to regulate and/or combine electricity 132 from different generators 100.

Other materials besides $Bi^{209}$ may be used in the fuel sample 110, such as $Bi^{208}$. However, $Bi^{208}$ reacts much more slowly than $Bi^{209}$, owing to the fact that $Bi^{209}$ must gain two neutrons before it can decay into $Po^{210}$ and then into lead. In addition, catalysts such as Beryllium (Be) may be added to the fuel sample 210 to amplify neutron generation initiated by the neutron source 120. In an example, the beryllium is formed in a thin film coating over the $Bi^{209}$.

In some examples, the control circuitry 150 is coupled to the neutron source 120 to provide the activation input 152 to the neutron source 120 and thereby to initiate the radioactive decay reactions in the fuel sample 110 and conversion of thermal energy to electrical energy 132 on demand. The control circuitry 150 may be implemented with a microcontroller or microprocessor; however, this is not required. For example, the control circuitry 150 can be as simple as a switch that applies a voltage to the neutron source 120 to initiate neutron emission. For example, a switch can be placed on an exterior wall of the generator 100 and a human operator or some mechanical device can actuate the switch to initiate emission of neutrons 122. In some arrangements, a switch may be provided as part of the neutron source 120 itself, such that no additional switch is used.

When implemented as a microcontroller or microprocessor, the control circuitry 150 may generate the activation input 152 electronically (e.g., via program code running in the control circuitry 150), and may provide the activation input 152 in the form of a pulse having a pulsewidth 154. In an example, the activation input 152 is an electronic signal having an initially LOW state corresponding to an OFF condition of the neutron source 120 and a HIGH state corresponding to an ON condition of the neutron source 120. The control circuitry 150 changes the state of the activation input 152 from LOW to HIGH to activate the neutron source 120 and later from HIGH to LOW to deactivate the neutron source 120. The duration of the pulsewidth 154 establishes a particular dose of neutrons 122, with different durations of the pulsewidth 154 causing the neutron source 120 to emit different doses. The amount of heat 114 emitted from the fuel sample 110 varies in relation to the neutron dose, with more heat 114 being emitted in response to higher doses. Thus, by establishing a particular pulsewidth 154 of the activation input 152, the control circuitry 150 causes the generator 100 to produce a certain amount of power, which is generally predicable given known starting parameters. By varying the pulsewidth 154 of the activation input 152, the control circuitry 150 causes the generator 100 to generate different amounts of power. It should be understood that some implementations of the neutron source 120 provide greater neutron emission in response to larger amplitudes of the activation input 152. In such examples, the control circuitry 150 may further vary the amplitude of the activation input 152 to provide further control over output power.

In some examples, a given initial dosage of neutrons 122 is enough to initiate radioactive decay reactions in the fuel sample 110 but only partially to consume the fuel sample 110. Thus, depending on the amount of Be or other catalysts present, the decay reactions in the fuel source 110 may be self-limiting. The control circuitry 150 may thus be configured to assert the activation input 152 a second time or repeatedly to reactivate the fuel sample and provide additional electrical output from the generator 100.

In some examples, the meter 160 is coupled to the set of thermoelectric converters 130 to measure the electrical output 132. The meter 160 is further coupled to the control circuitry 150 to provide a feedback signal 162 to the control circuitry 150. The feedback signal 162 varies in relation to the electrical output 132, and the control circuitry 150 is configured to detect, based on the feedback signal 162, when the electrical output 132 drops below a predetermined level. When such detection is made, the control circuitry 150 again provides the activation input 152 to the neutron source 120 to reactivate the fuel sample 110 and increase the electrical output 132. Eventually, the fuel sample 110 will become spent, but it is envisaged that monitoring the electrical output 132 and reactivating the fuel sample 110 can extend service life of the generator 100 significantly.

In some examples, the control circuitry 150 is coupled to the communication receiver 170 to receive commands from a remote system (not shown). For example, the generator 100 may be deployed on a space vehicle and the remote system may be a ground based control center. The remote system transmits a remotely generated activation signal 172, which the communication receiver 170 receives and hands off to the control circuitry 150. When the control circuitry 150 receives the remotely generated activation signal 172, the control circuitry 150 proceeds to generate the activation signal 152 to activate the fuel sample 110 and initiate (or re-initiate) power generation.

Figure 2:
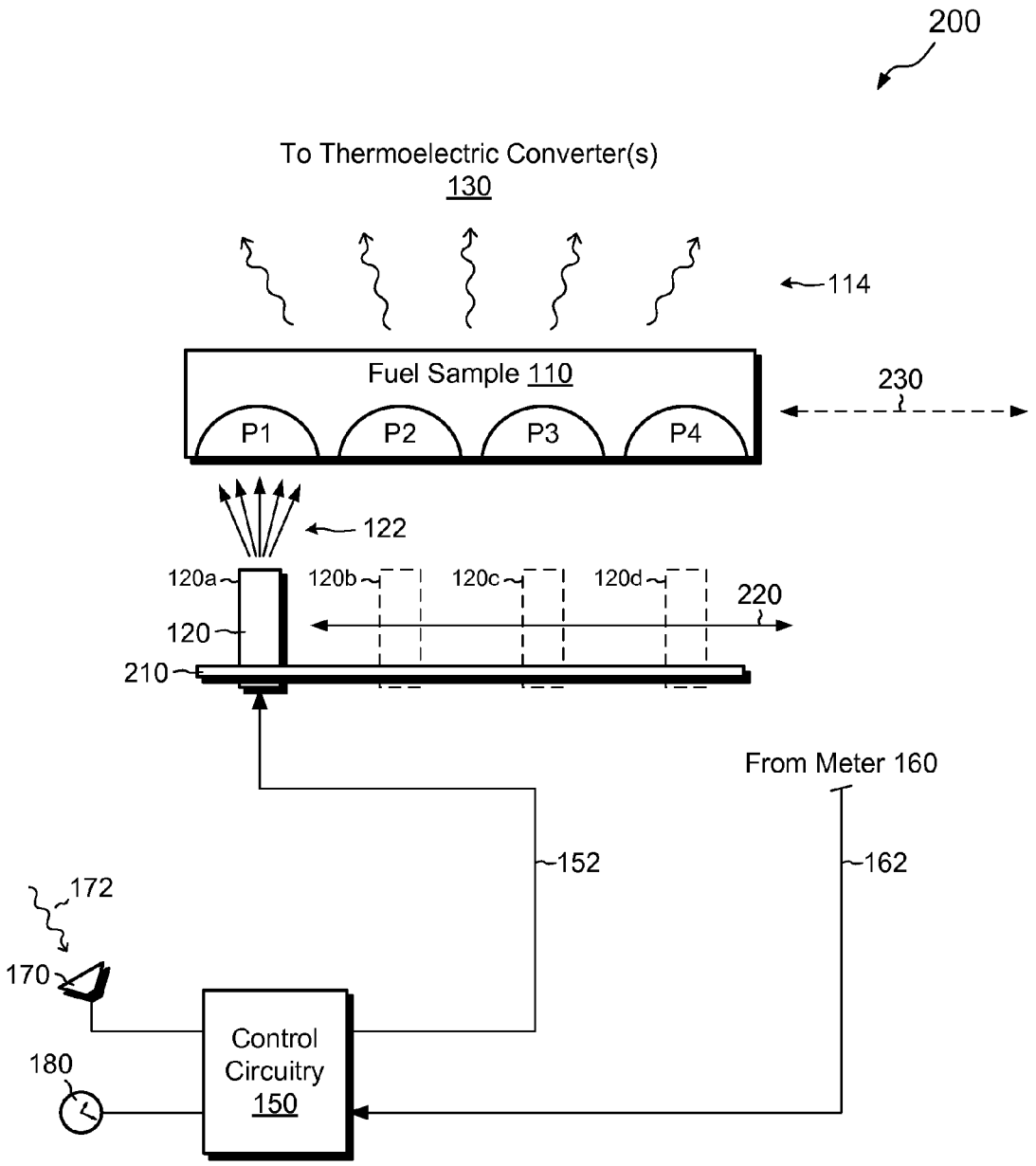
FIG. 2 is a block diagram of another example illustrating activation of multiple portions of the fuel sample by irradiating the portions with a neutron source that is moveable relative to the fuel sample.

FIG. 2 shows a block diagram of a thermoelectric generator 200 according to another example embodiment. In example, the thermoelectric generator 200 is similar to the thermoelectric generator 100 and includes similar components that operate in similar ways. The thermoelectric converter(s) 130, power management 140, and meter 160 have been omitted from FIG. 2 to enable the figure to focus on differences between the generator 200 and the generator 100.

The fuel sample 110 of the generator 200 is seen to include multiple portions, P1, P2, P3, and P4, and the neutron source 120 is seen to be moveable, e.g., along a track or rail 210 and along direction 220, to assume any of positions 120*a*, 120*b*, 120*c*, or 120*d*, to expose the portions P1 to P4 to neutrons 122. Alternatively (or in addition), the fuel sample 110 may itself be moveable, e.g., along a track or rail (not shown) and along direction 230, to expose the different portions P1 to P4 to neutrons 120 emitted from the neutron source 120.

In example operation, the control circuitry 150 directs movement of the neutron source 120 (e.g., by a motor or other actuator) to position 120*a* and asserts the activation input 152, thereby causing the neutron source 120 to emit neutrons 122 into the first portion P1 of the fuel sample 110. The neutrons 122 initiate radioactive decay in the first portion P1, which generate heat 114, and the thermoelectric converter(s) 130 convert the heat 114 to electricity 132.

Later, the control circuitry 150 directs movement of the neutron source 120 to position 120*b*, where the neutron source 120 emits neutrons 122 into portion P2. Similar actions can be repeated for positions 120*c* and 120*d*, exposing portions P3 and P4 to neutrons 122 and inducing radioactive decay in the respective portions.

In some examples, the control circuitry 150 exposes the different portions P1 to P4 to neutrons 122 based on a predetermined sequence and with predetermined timing. For example, the control circuitry 150 may advance the neutron source 120 to the next position every 138 days (the half-life of $Po^{210}$) to expose the next portion to neutrons. The lifespan of the generator 200 may thus be prolonged greatly by sequentially initiating radioactive decay in the different portions P1 to P4. The control circuitry 150 may vary the pulsewidth 154 (and/or amplitude) of the activation input 152, as described above, for generating different levels of output power. Also, the control circuitry 150 may move the neutron source 120 and expose the next portion to neutrons more or less frequently than the 138 days stated above, to adjust output power.

In some examples, the generator 200 operates with feedback, wherein the control circuitry 150 monitors the feedback signal 162 and advances the neutron source 120 to the next position to activate the next portion of the fuel sample 110 when the feedback signal 162 indicates that the electrical output 132 has fallen below a predetermined threshold.

Although the fuel sample 110 is shown as having a rectangular shape with portions P1 to P4 arranged along a line, those skilled in the art would recognize that many different shapes can be used for the fuel sample 110 and its portions and that no particular geometrical arrangement is required. The one shown is merely illustrative.

Figure 3:
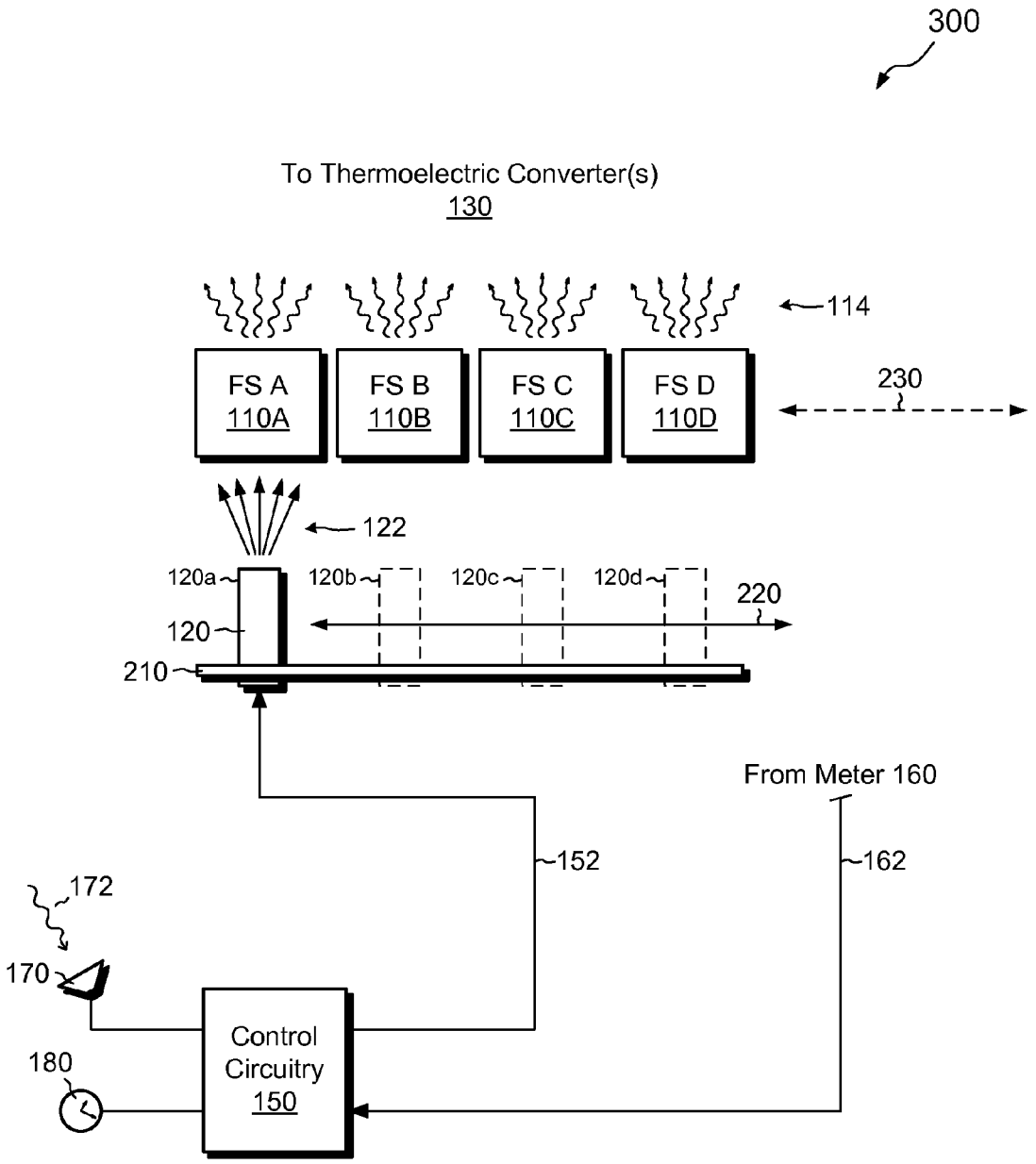
FIG. 3 is a block diagram of another example illustrating activation of multiple fuel samples with a neutron source that is moveable relative to the fuel samples.

FIG. 3 shows a block diagram of a thermoelectric generator 300. The generator 300 may be similar to the generators 100 and 200 described above and may operate in similar ways, but here the fuel sample is provided in multiple distinct samples 110A, 110B, 110C, and 110D. In an example, the samples 110A to 110D are provided as distinct "cells" in respective sealed containers with respective sets of thermoelectric converters 130.

Figure 4:
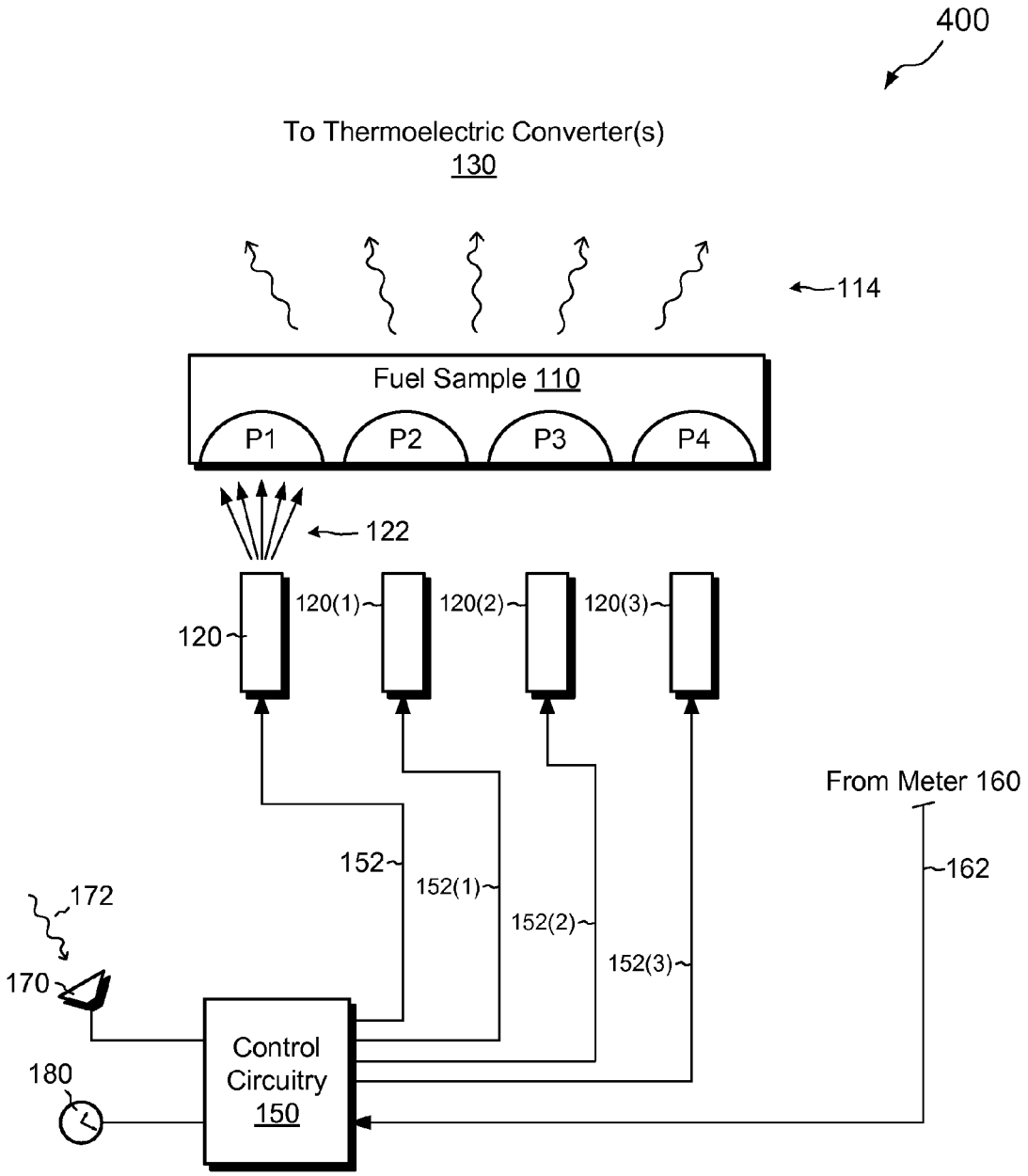
FIG. 4 is a block diagram of another example illustrating activation of multiple portions of a fuel sample where each fuel portion is activated by its respective neutron source.
Figure 5:
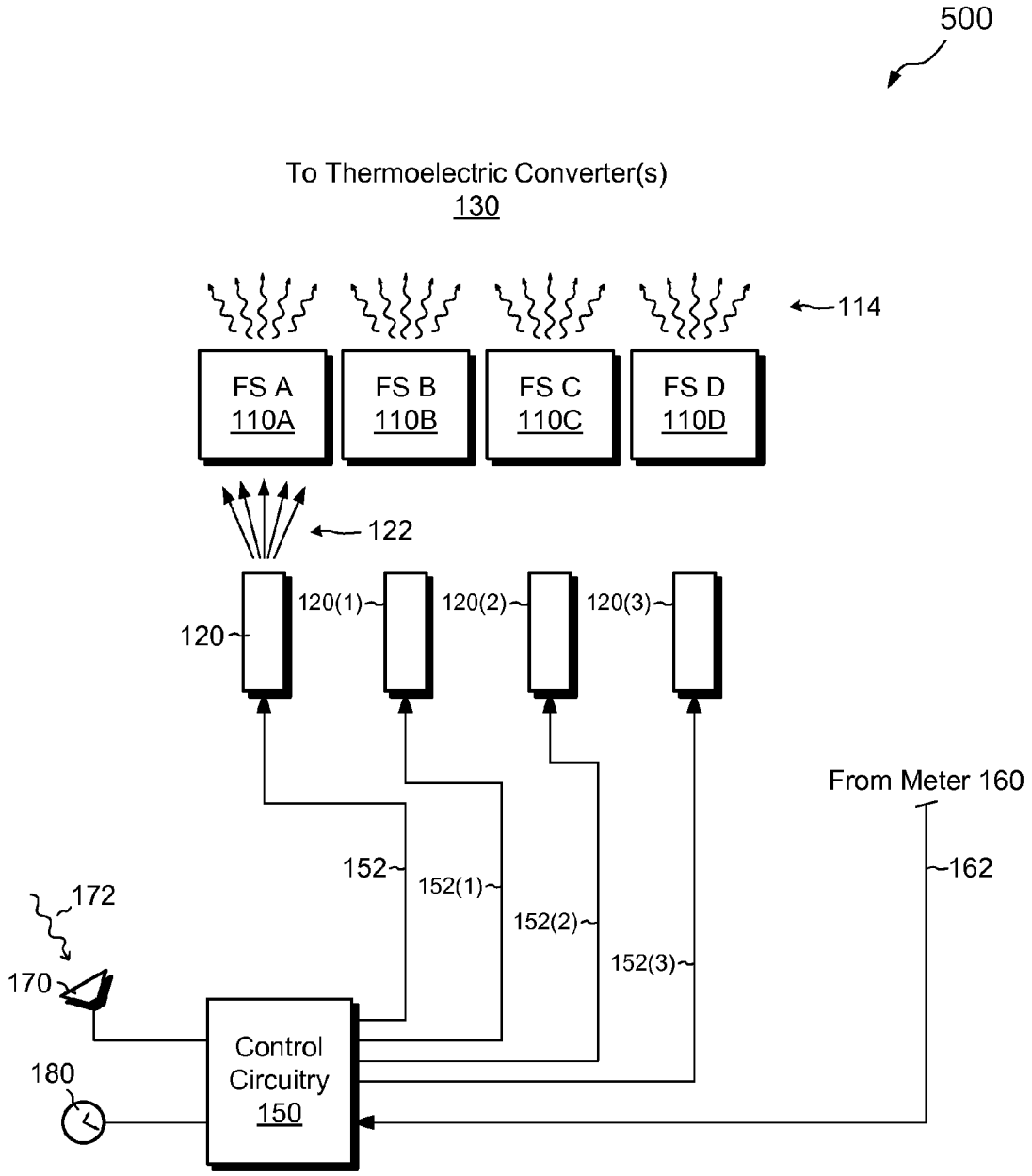
FIG. 5 is a block diagram of another example illustrating activation of multiple fuel samples where each fuel sample is activated by a respective neutron source.
Figure 6:
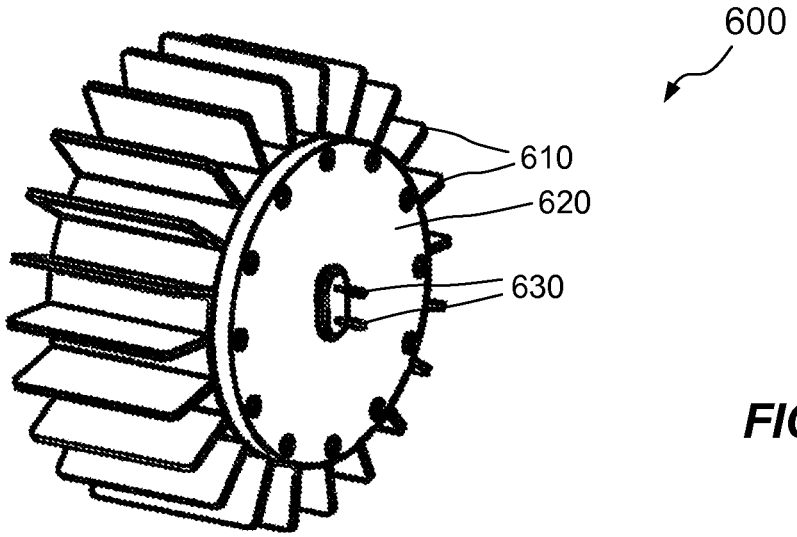
FIGS. 6-9 are perspective views of a particular example implementation of a thermoelectric generator.
Figure 7:
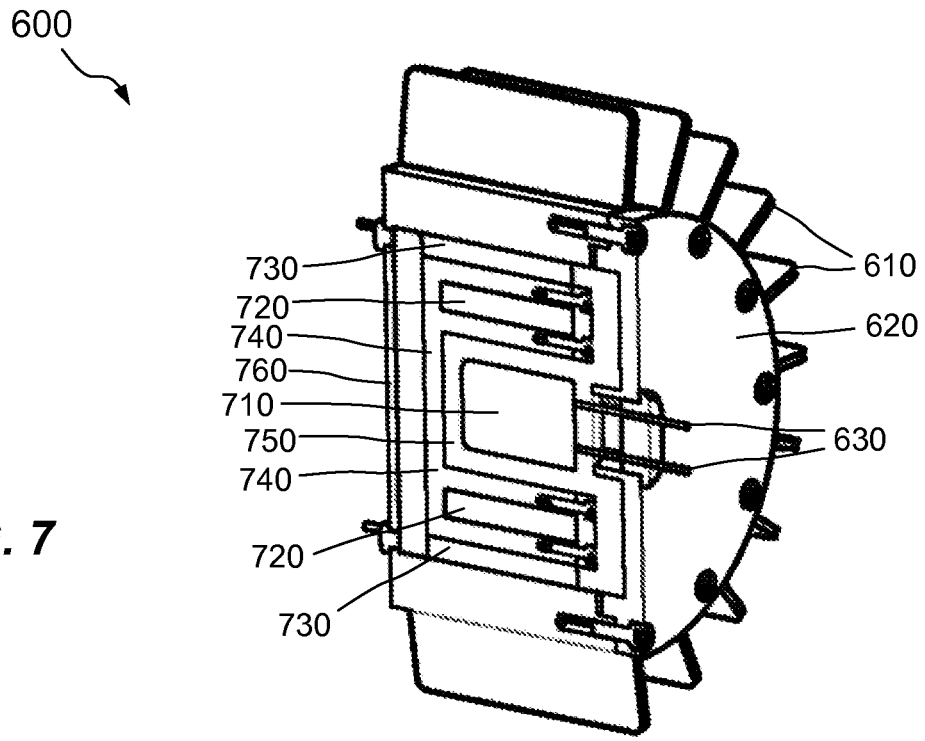
Figure 8:
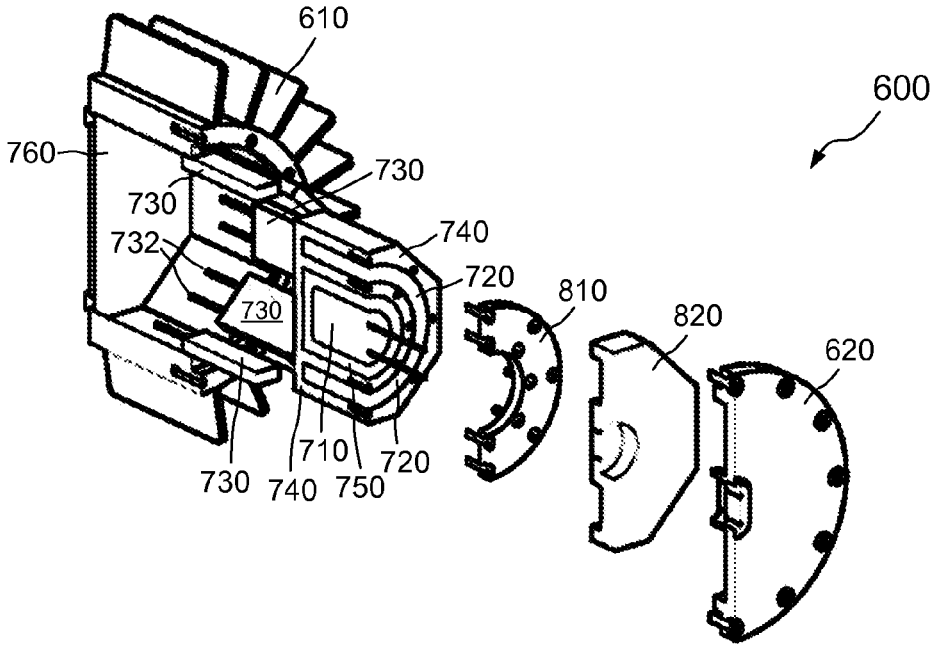
Figure 9:
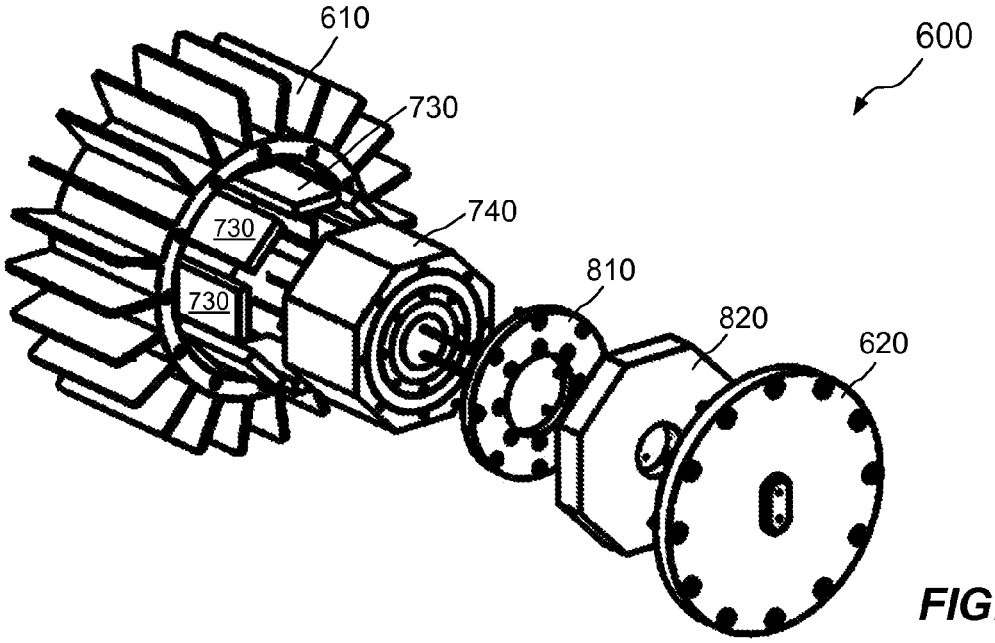

FIGS. 4 and 5 show arrangements that are similar to those shown in FIGS. 2 and 3, respectively. Here, however, rather than moving a single neutron source 120 to expose different portions P1 to P4 (or different distinct samples 110A to 110D) from a single neutron source 120, a different neutron source is provided for each sample portion or distinct sample. In FIG. 4, for example, the neutron source 120 emits neutrons for irradiating portion P1 of the fuel sample 110, and additional neutron sources 120(1), 120(2), and 120(3) emit neutrons for irradiating portions P2, P3, and P4, respectively. In FIG. 5, the neutron source 120 emits neutrons for irradiating fuel sample 110A, and additional neutron sources 120(1), 120(2), and 120(3) emit neutrons for irradiating additional fuel samples 110B, 110C, and 110D, respectively. The neutron sources 120(1) to 120(3) are activated in response to respective activation inputs 152(1) to 152(3) from the control circuitry 150. The control circuitry 150 is configured to apply activation inputs 152 and 152(1) to 152(3) to the neutron source 120 and the additional neutron sources 120(1) to 120(3) in a timing sequence to expose the different portions P1 to P4 (or fuel samples 110A to 110D) to neutron emission at different times, such that, as radioactive decay reactions in one portion or fuel sample diminishes over time, radioactive decay reactions in other portions or fuel samples are increased to extend a service life of the generator.

FIGS. 6-9 are perspective views of a particular example implementation of a thermoelectric generator 600. The thermoelectric generator 600 is seen to include a neutron source 710 having electrical leads 630 for receiving an activation input, a fuel sample 720, and a set of thermoelectric generators 730. A thermal insulator 750 surrounds the neutron source 710, and thermally conductive material 740 conducts heat from the fuel sample 720 to the thermoelectric generators 730. A first end cap 630 covers and seals the generator 600 at one end, and a second end cap 760 covers and seals the generator 600 at the other end. Caps 810 and 820 provide additional sealing and protection.

Figure 10:
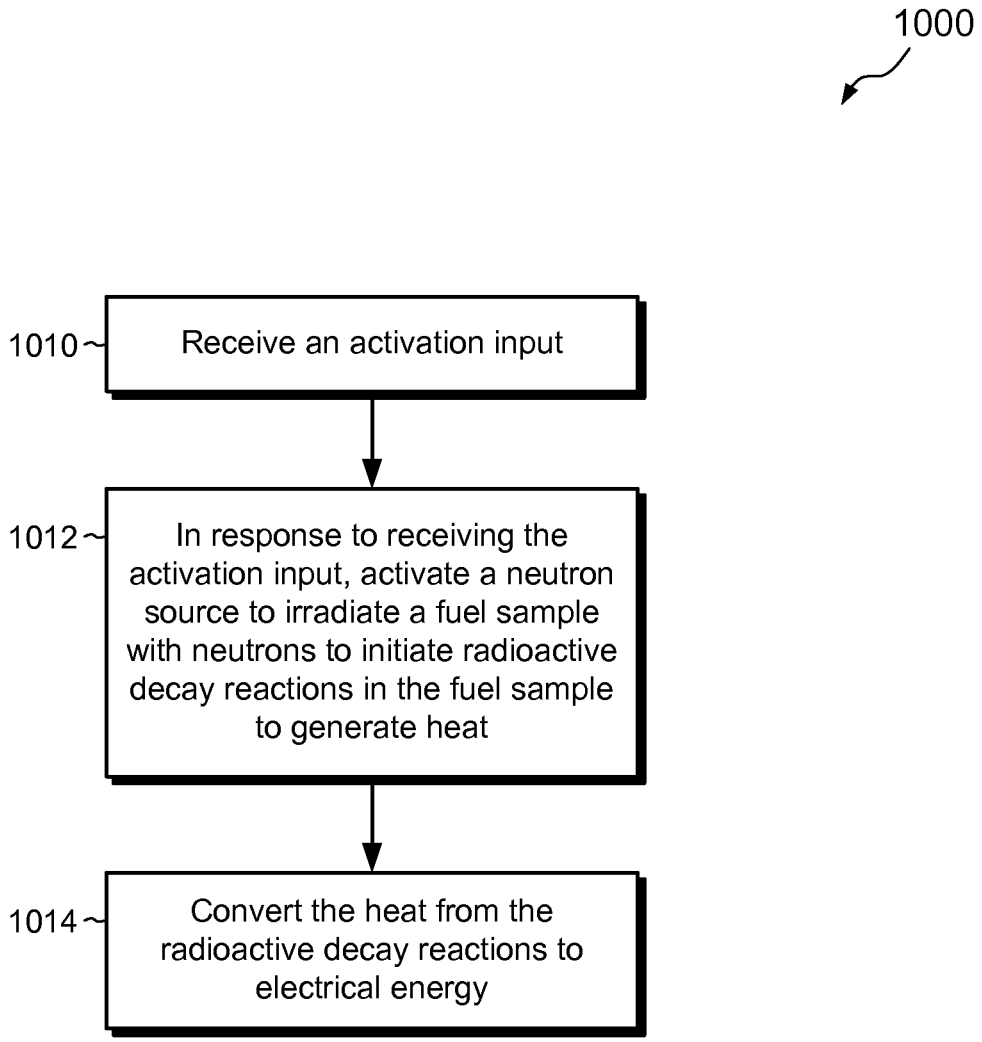
FIG. 10 is a flowchart showing an example process for generating electrical power on demand.

FIG. 10 is a flowchart illustrating an example process 1000 for generating electrical power on demand. The process 1000 may be carried out, for example, by any of the thermoelectric generators shown in FIGS. 1-9.

At step 1010, an activation input is received. For example, the neutron source 120 receives the activation input 152.

At step 1012, a neutron source is activated to irradiate a fuel sample with neutrons to initiate radioactive decay reactions in the fuel sample to generate heat. For example, the neutron source 120 is activated to irradiate the fuel sample 110 with neutrons 122 to initiate radioactive decay reactions in the fuel sample 110 to generate heat 114.

At step 1014, the heat from the radioactive decay reactions is converted to electrical energy. For example, the thermoelectric converter(s) 130 convert the heat 114 to electrical energy 132.

Improved techniques have been described in which a thermoelectric generator employs a safe, initially dormant, stable, non-radioactive fuel sample which is activated on-demand by a neutron source which initiates and controls activation of the fuel sample. The improved technique allows thermoelectric generators to be fully assembled and stored for extended periods of time before they are deployed for use, and then activated on demand only when the need arises for them to generate power.

Having described certain embodiments, numerous alternative embodiments or variations can be made. For example, although FIGS. 2 and 4 each show four portions P1 to P4 of the fuel sample, it is understood that the fuel sample 110 may include any number of portions. Also, the embodiments of FIGS. 3 and 5 may include any number of distinct fuel samples.

Also, the neutron source 120 (and sources 120(1-3)) may be of any suitable type and may emit neutrons 122 in any suitable radiation pattern, such as in a pencil beam, a fan beam, a conical pattern, a cylindrical pattern, or any pattern.

Further, any of the thermoelectric generators described above may be used both to generate electricity and to generate heat. Heat 114 that is not converted to electrical energy may thus be used to heat the environment in which the generator is deployed.

Further, although features are shown and described with reference to particular embodiments hereof, such features may be included and hereby are included in any of the disclosed embodiments and their variants. Thus, it is understood that features disclosed in connection with any embodiment are included as variants of any other embodiment.

As used throughout this document, the words "comprising," "including," and "having" are intended to set forth certain items, steps, elements, or aspects of something in an open-ended fashion. Also, as used herein and unless a specific statement is made to the contrary, the word "set" means one or more of something. Although certain embodiments are disclosed herein, it is understood that these are provided by way of example only and the invention is not limited to these particular embodiments.

Those skilled in the art will therefore understand that various changes in form and detail may be made to the embodiments disclosed herein without departing from the scope of the invention.

What is claimed is:

1. A thermoelectric generator with on-demand activation for use on a space vehicle, comprising:

a fuel sample;

a neutron source having electrical leads and constructed and arranged to emit neutrons into the fuel sample to initiate radioactive decay reactions in the fuel sample in response to the neutron source receiving an activation input at the electrical leads; and a thermoelectric converter coupled to the fuel sample to convert thermal energy from the radioactive decay reactions to electrical energy, the thermoelectric generator thus constructed and arranged to generate power for the space vehicle on demand in response to the neutron source receiving the activation input, wherein the fuel sample includes stable $Bi^{209}$, and wherein the radioactive decay reactions include (i) a radioactive decay of $Bi^{210}$ to $Po^{210}$ (ii) a radioactive decay of $Po^{210}$ to stable $Pb^{206}$, and wherein the fuel sample further includes a catalyst to amplify neutron generation initiated by the neutron source.

2. A thermoelectric generator as in claim 1, wherein the catalyst includes beryllium formed in a thin film coating over the $Bi^{209}$.

3. A thermoelectric generator as in claim 1, further comprising control circuitry coupled to the neutron source to provide the activation input to the neutron source and thereby to initiate the radioactive decay reactions in the fuel sample and conversion of thermal energy into electrical energy on demand.

4. A thermoelectric generator as in claim 3, further comprising a communication receiver coupled to the control circuitry to receive a remotely generated activation signal while the thermoelectric generator is deployed in outer space, wherein the control circuitry is further constructed and arranged to provide the activation input to the neutron source in response to the communication receiver receiving the remotely generated activation signal.

5. A thermoelectric generator as in claim 3, wherein the neutron source is constructed and arranged to emit neutrons into the fuel sample at a level that varies in relation to a pulsewidth of the activation input, and wherein the control circuitry is further constructed and arranged to output the activation input with different pulsewidths to initiate different levels of radioactive decay reactions in the fuel sample and thereby to cause the thermoelectric generator to generate different amounts of electrical energy.

6. A thermoelectric generator as in claim 5, further comprising a meter coupled to the thermoelectric converter to measure an electrical output level of the thermoelectric converter, wherein the meter is further coupled to the control circuitry to provide feedback to the control circuitry that varies in relation to the electrical output level of the thermoelectric converter, wherein the control circuitry is further constructed and arranged to detect, based on the feedback, when the electrical output level from the thermoelectric converter drops below a predetermined level and then to again provide the activation input again to the neutron source to reactivate the fuel sample to increase the electrical output level.

7. A thermoelectric generator as in claim 3, wherein the neutron source and the fuel sample are moveable relative to each other within the thermoelectric generator to expose different portions of the fuel sample to neutron emission, wherein the control circuitry is further constructed and arranged to provide the activation input to the neutron source multiple times to activate the different portions of the fuel sample in sequence.

8. A thermoelectric generator as in claim 3, further comprising a set of additional neutron sources disposed in relation to the fuel sample to expose different portions of the fuel sample to neutron emission, wherein each of the set of additional neutron sources is coupled to the control circuitry to receive a respective activation input from the control circuitry.

9. A thermoelectric generator as in claim 8, wherein the control circuitry is further constructed and arranged to apply activation inputs to the neutron source and the set of additional neutron sources in a timing sequence to expose the different portions of the fuel sample to neutron emission at different times, such that, as radioactive decay reactions in one portion of the fuel sample diminish over time, radioactive decay reactions in another portion of the fuel sample are increased to extend a service life of the fuel sample.

10. A thermoelectric generator as in claim 3, further comprising a set of additional fuel samples of a same initial composition as the fuel sample and a set of additional neutron sources each disposed in relation to a respective additional fuel sample to expose the set of additional fuel samples to neutron emission, wherein each of the set of additional neutron sources is coupled to the control circuitry to receive a respective activation input from the control circuitry to initiate radioactive decay reactions in the respective fuel sample and conversion of thermal energy into electrical energy on demand.

11. A thermoelectric generator as in claim 10, wherein the control circuitry is further constructed and arranged to apply activation inputs to the neutron sources in a timing sequence to expose the different fuel samples to neutron emission at different times, such that, as radioactive decay reactions in one fuel sample diminish over time, radioactive decay reactions in another fuel sample are increased to extend a service life of the thermoelectric generator.

12. A thermoelectric generator with on-demand activation for use in a space vehicle, comprising:

multiple fuel samples each including $Bi^{209}$;

multiple neutron sources, each neutron source having electrical leads and disposed in relation to one of the fuel samples to emit neutrons into the respective fuel sample to initiate radioactive decay reactions in the fuel sample in response to the neutron source receiving an activation input at the electrical leads;

multiple thermoelectric converters, each thermoelectric converter coupled to a respective one of the fuel samples to convert thermal energy from the radioactive decay reactions in the fuel sample to electrical energy; and control circuitry coupled to each of the neutron sources to provide the respective activation input to each of the neutron sources, wherein the control circuitry is constructed and arranged to apply activation inputs to the neutron sources in a timing sequence to expose the respective fuel samples to neutron emission at different times, such that, as radioactive decay reactions in one fuel sample diminish over time, radioactive decay reactions in another fuel sample are increased to extend a service life of the thermoelectric generator, the thermoelectric generators thus constructed and arranged to generate power for the space vehicle on demand in response a respective neutron source receiving an activation input, wherein the radioactive decay reactions include (i) a radioactive decay of $Bi^{210}$ to $Po^{210}$ and (ii) a radioactive decay of $Po^{210}$ to stable $Pb^{206}$, and wherein the fuel sample further includes a catalyst to amplify neutron generation initiated by the neutron source.

13. A thermoelectric generator as in claim 1, wherein the fuel sample, the neutron source, and the thermoelectric converter are embodied together in a thermoelectric generator assembly, wherein the neutron source is disposed along a central axis of the thermoelectric generator assembly, and wherein the thermoelectric converter includes multiple thermoelectric converter elements disposed concentrically around the neutron source.

14. A thermoelectric generator as in claim 13, wherein the fuel sample is disposed concentrically around the neutron source between the neutron source and the thermoelectric converter elements.

15. A thermoelectric generator as in claim 14, wherein the thermoelectric generator assembly further includes an insulating layer disposed concentrically around the neutron source between the neutron source and the fuel sample.

* * * * *